US005450182A

United States Patent [19]

Wayman et al.

[11] Patent Number: 5,450,182

[45] Date of Patent: Sep. 12, 1995

[54] APPARATUS AND METHOD FOR FUSING TONER IMAGES ON TRANSPARENT SUBSTRATES

[75] Inventors: Wililam H. Wayman, Ontario; Rasin Moser, Fairport, both of N.Y.

[73] Assignee: Xerox Corporations, Stamford, Conn.

[21] Appl. No.: 169,802

[22] Filed: Dec. 16, 1993

[51] Int. Cl.[6] ..... G03G 15/20

[52] U.S. Cl. ..... 355/285

[58] Field of Search ..... 355/285, 289, 290

[56] References Cited

U.S. PATENT DOCUMENTS

| | | | |
|---|---|---|---|
| 4,563,073 | 1/1986 | Reynolds | 355/290 X |
| 4,565,439 | 1/1986 | Reynolds | 355/290 |
| 5,084,738 | 1/1992 | Ishikawa | 355/285 |
| 5,099,288 | 3/1992 | Britto et al. | 355/290 |
| 5,115,279 | 5/1992 | Nishikawa et al. | 355/290 |
| 5,182,606 | 1/1993 | Yamamoto et al. | 355/289 |
| 5,262,834 | 11/1993 | Kusaka et al. | 355/285 |
| 5,278,618 | 1/1994 | Mitani et al. | 355/285 |
| 5,321,480 | 6/1994 | Merle et al. | 355/285 |

*Primary Examiner*—Fred L. Braun

[57] ABSTRACT

A belt fuser for fusing toner images to transparency material without having to resort to off-line methods and apparatus. The toner images which are formed on the transparency during the imaging process have time to cool prior to separation from a smooth-surfaced belt.

The peak fusing temperature is significantly higher than used with conventional fusers such as heat and pressure roll fusers. This higher temperature guarantees excellent toner melting and flow thereby producing transparencies with excellent projection efficiency.

4 Claims, 3 Drawing Sheets

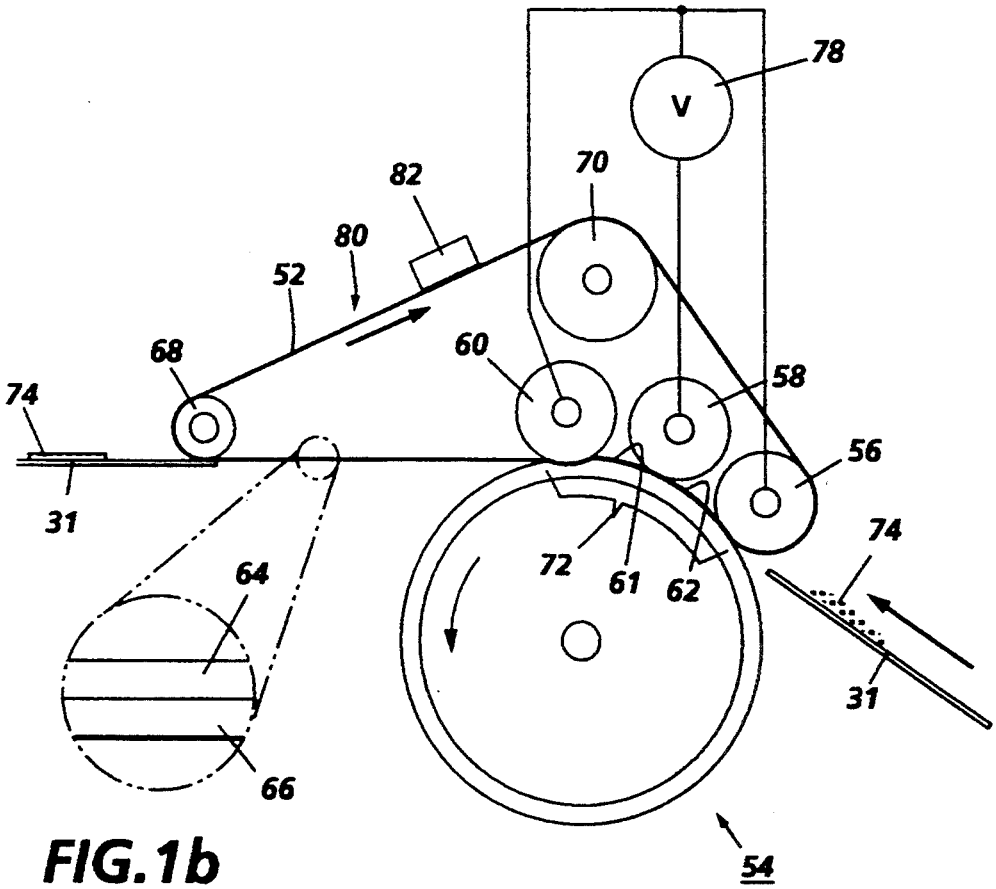
FIG.1b
FIG.1a
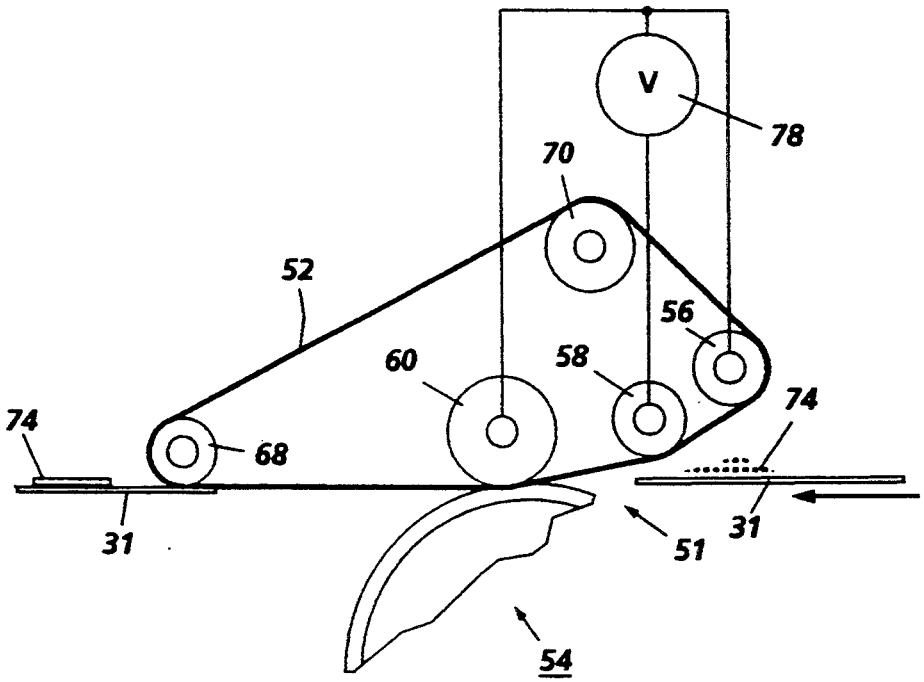
FIG. 2

APPARATUS AND METHOD FOR FUSING TONER IMAGES ON TRANSPARENT SUBSTRATES

BACKGROUND OF THE INVENTION

This invention relates to the art of forming powder images and, more particularly, to heat and pressure belt fuser apparatus for fusing toner images to transparencies.

In the art of xerography or other similar image reproducing arts, a latent electrostatic image is formed on a charge-retentive surface which may comprise a photoconductor which generally comprises a photoconductive insulating material adhered to a conductive backing. When the image is formed on a photoconductor, the photoconductor is first provided with a uniform charge after which it is exposed to a light image of an original document to be reproduced. The latent electrostatic images, thus formed, are rendered visible by applying any one of numerous pigmented resins specifically designed-for this purpose.

It should be understood that for the purposes of the present invention the latent electrostatic image may be formed by means other than by the exposure of an electrostatically charged photosensitive member to a light image of an original document. For example, the latent electrostatic image may be generated from information electronically stored or generated, and this information in digital form may be converted to alphanumeric images by image generation electronics and optics. However, such image generation electronic and optic devices form no part of the present invention.

When a reusable photoconductive surface is utilized, the pigmented resin, more commonly referred to as toner which forms the visible images is transferred to a substrate such as plain paper. After transfer the images are made to adhere to the substrate using a fuser apparatus.

To date the most widely accepted approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with a release layer such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retrained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem it has been common practice to utilize toner release agents such as silicone oil, in particular, polydimethyl silicone oil, which is applied to the fuser roll surface to a thickness of the order of about 0.2 micron to act as a toner release material. These materials provide a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface.

Heat and pressure roll fuser systems used for fusing toner images on various substrates have proven to be unsatisfactory for fusing on smooth transparent substrates such as Mylar, particularly when the toner comprises colored thermoelectric particles. This is because of the low projection efficiency of transparencies fused in this manner. One reason for this may be attributed to the fact that stripping toner images from a hot fuser roll imparts toner layer surface texture. For black images projection efficiency is not a factor, however, for colored images, a rough surface texture imparts optical diffusivity to the images leading to a low projection efficiency and resultant lack of color clarity. For roll fuser systems there is an upper temperature limit for precluding "hot-offset" due to the toner becoming molten instead of just tacky as required in order to preclude "hot-offset".

The projection efficiency of transparencies has been improved using an off-line fuser or transparency finisher marketed by the Canon corporation the transparency or other substrate to be finished or "glossed" is placed in a smooth clear plastic envelope and then fed through a pair of heated rollers. The toner melts and cools against the envelope. The envelope is then peeled back to retrieve the transparency or copy.

Another known method of improving the gloss of color xerographic images on a transparent substrate comprises refusing the color images. Such a process was observed at a NOMDA trade show in 1985 at a Panasonic exhibit. The process exhibited was carried out using an off-line transparency fuser, available from Panasonic as model FA-F100, in connection with a color xerographic copier which was utilized for creating multi-color toner images on a transparent substrate for the purpose of producing colored slides. Since the finished image from the color copier was not really suitable for projection, it was refused using the aforementioned off-line refuser. To implement the process, the transparency is placed in a holder intermediate which consists of a clear relatively thin sheet of plastic and a more sturdy support. The holder is used for transporting the imaged transparency through the off-line refuser. The thin clear sheet is laid on top of the toner layer on the transparency. After passing out of the refuser, the transparency is removed from the holder. This process resulted in an attractive high gloss image useful in image projectors. However, the gloss is image-dependent. Thus, the gloss is high in areas of high toner density because the toner refuses in contact with the smooth plastic sheet and takes on that surface smoothness. In areas where there is little or no toner the gloss is only that of the substrate. The refuser was also used during the exhibit for refusing color images on paper.

As will be appreciated, it is desirable to fuse transparencies such that projection efficiency is optimized without the need to resort to off-line devices for that purpose.

Certain publications and patent applications noted as being possibly relevant to certain aspects of the present invention will now be discussed.

U.S. patent application Ser. No. 08/168,835 filed on Dec. 16, 1993 which is assigned to the same assignee as the instant invention relates to a belt fuser wherein three fuser rollers cooperate with a pressure roller to form an extended fusing zone through which a substrate carrying toner images passes with the toner images contacting fusing belt. Electrical power is applied to the three contact rolls in such a manner that only the portions of the belt in the fusing zone are heated. Thus, the energy is concentrated only in the part of the fusing belt where it is needed for fusing the toner images on the final substrate. Thus, the free extent of the belt or in other words the portion of the belt outside of the fusing zone remains unheated.

To ensure good electrical contact in the presence of silicone oil contamination on the electrically resistive inner surface of the fusing belt, the contact rollers are textured by knurling, bead blasting or other suitable means.

U.S. patent application Ser. No. 08/169,836 no Dec. 16, 1993 which is assigned to the same assignee as the instant invention relates to belt fuser wherein three fuser rollers cooperate with a pressure roller to form an extended fusing zone through which a substrate carrying toner images passes with the toner images contacting a fusing belt. Electrical power is applied to the three fuser rolls in such a manner that only the portions of the belt between the rollers are heated to a predetermined operating temperature in accordance with a setpoint temperature. The free extent of the belt or in other words the portion of the belt outside of the fusing zone is adapted to be heated to various operating temperatures in order to produce prints with different gloss as desired.

U.S. patent application Ser. No. 08/169,838 filed on Dec. 16, 1993 which is assigned to the same assignee as the instant invention relates to a power controller, which does not rely on the use of sensors such as thermistors to control the operating temperature of a belt fuser. It features various preset inputs to control: steady state watts/in, cold start boost watts/in, warmup and cooldown time constants.

The controller sets the desired power based on the on-off cycling of the system. For a cold start, the steady state plus boost power is used, during warmup the boost level is exponentially decreased at a rate set by a warmup time constant. When at rest (with no applied power) the power setpoint is exponentially increased at a rate set by a cool down time constant.

U.S. patent application Ser. No. 08/168,833 filed on Dec. 16, 1993 which is assigned to the same assignee as the instant invention relates to a belt fuser wherein three fuser rollers cooperate with a pressure roller to form an extended fusing zone through which a substrate carrying toner images passes with the toner images contacting fusing belt. Electrical power is applied to the three fuser rolls in such a manner that only the portions of the belt in the fusing zone are heated. Thus, the energy is concentrated only in the part of the fusing belt where it is needed for fusing the toner images on the final substrate. Thus, the free extent of the belt or in other words the portion of the belt outside of the fusing zone remains unheated.

U.S. patent application Ser. No. 08/168,891 on Dec. 16, 1993 which is assigned to the same assignee as the instant invention relates to belt fuser wherein three fuser rollers cooperate with a pressure roller to form an extended fusing zone through which a substrate carrying toner images passes with the toner images contacting fusing belt. Electrical power is applied to the three fuser rolls in such a manner that only the portions of the belt in the fusing zone are heated. Thus, the energy is concentrated only in the part of the fusing belt where it is needed for fusing the toner images on the final substrate. The free extent of the belt or in other words the portion of the belt outside of the three rollers remains unheated. Toner images are directly formed on or transferred to the unheated portion of the fusing belt. The images carried by the belt are then moved through the fusing zone where the images are simultaneously fused and transferred to a final substrate.

U.S. Pat. No. 4,565,439 granted to Scott D. Reynolds on Jan. 21, 1986 relates to a belt fuser for fusing toner images. The fusing apparatus is characterized by the separation of the heat and pressure functions such that the heat and pressure are effected at different locations on a thin flexible belt forming the toner contacting surface. A pressure roll cooperates with a non-rotating mandrel to form a nip through which the belt and copy substrate pass simultaneously. The belt is heated such that by the time it passes through the nip its temperature together with the applied pressure is sufficient for fusing the toner images passing therethrough. The non-rotating mandrel is adapted to having its axis skewed relative to the axis of the pressure roll. A pair of edge sensors are provided for activating a mandrel skewing mechanism. Skewing of the mandrel by such mechanism effects proper belt tracking.

U.S. Pat. No. 4,563,073 granted to Scott D. Reynolds on Jan. 7, 1986 relates to a low mass heat and pressure fuser and release agent management system therefor.

U.S. Pat. No. 5,084,738 granted to Noriyoshi Ishikawa on Jan. 28, 1992 discloses a fusing apparatus having an electrically conductive film which moves in contact with a recording material to which a toner image has been transferred, a pressing roller for causing the film to be brought into contact with the recording material and a plurality of electrodes disposed along a nip between the film and the pressing roller at a position opposing this pressing roller. The electrically conductive film heats up substantially only in the nip as the result of an electrical conductance to this electrode. The toner image on the recording material is heated and fixed by the heat generated in the electrically conductive film positioned in the nip. In a modified embodiment of the foregoing fusing device, a fusing film is fabricated using a thin-film conductive layer made by aluminum deposition or the like. The conductive layer is disposed on the side of a base film comprising carbon black added to a polycarbonate that will contact the transfer material on which a picture image is carried. Power is supplied between a first electrode and a second electrode. Joule heat is produced in the thickness direction of the fusing film.

U.S. Pat. No. 5,182,606 granted on Jan. 26, 1993 discloses an image fusing apparatus including a heater; a film movable with a recording material, in which the recording material has a toner image thereon which is heated through the film by heat from the heater; and the film has a heat resistive resin base layer containing inorganic electrically insulative filler material and a parting layer containing electrically conductive filler material.

BRIEF SUMMARY OF THE INVENTION

The belt fuser of the present invention works exceptionally well for fusing transparencies without having to resort to off-line methods as in the case of the Canon process. According to the present invention, the transparency has time to cool prior to its separation from a smooth-surfaced belt. Thus, the peak fusing temperature can be higher than with a conventional fuser such as a roll fuser. This higher temperature guarantees excellent toner melting and flow thereby producing transparencies with excellent projection efficiency.

According to the present invention, a compact, lightweight fuser which reaches fusing temperature and power in less than one second is provided. To this end it utilizes a thin film polymeric, seamless belt with an electrically resistive coating.

The belt is moved through a fusing zone formed by a pressure roll and three electrically conductive contact rollers which are electrically biased such that heating only occurs in the portions of the belt in the fusing zone. The smooth surface of the release layer contacts the toner images.

A stripping roller (i.e. a relatively small radiused roller) about which the fusing belt is partially entrained, is positioned remotely from the fusing zone such that the toner images contact the belt for a sufficient period of time for allowing the toner images to cool prior to stripping.

Elevating the toner to the higher temperature mentioned so that the toner becomes molten and contacting the toner material with the smooth-surfaced belt result in the creation of transparencies having enhanced projection efficiency. Allowing the toner to cool makes it possible to elevate the toner temperature to a molten state during fusing.

For a better understanding of the present invention, the invention will be described with reference to the accompanying drawings wherein:

DESCRIPTION OF THE DRAWINGS

FIG. 1*a* is a schematic illustration of a belt fusing apparatus according to the invention.

FIG. 1*b* is an enlarged view depicting a fuser belt.

FIG. 2 is a schematic illustration of a modified embodiment of the invention illustrated in FIG. 1.

DESCRIPTION OF THE PREFERRED EMBODIMENT OF THE INVENTION

Figure 4:
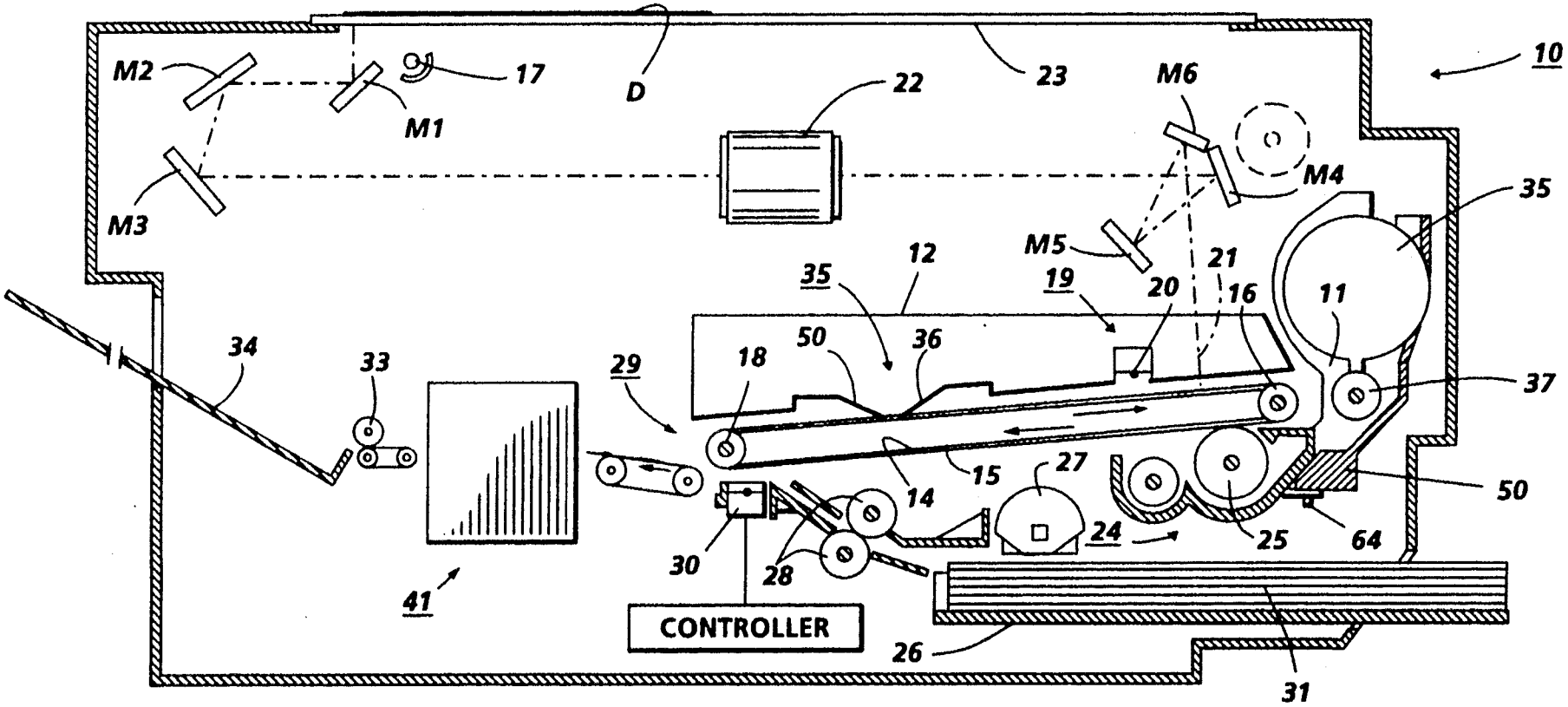
FIG. 4 is a schematic illustration of an imaging apparatus in which the fuser apparatus of FIG. 1 can be utilized.

Referring now to FIG. 4 there is shown by way of example, an automatic electrostatographic reproducing machine 10 which includes a removable processing cartridge 12. The reproducing machine depicted in FIG. 4 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems such as printers and is not necessarily limited in application to the particular embodiment shown herein.

The reproducing machine 10 illustrated in FIG. 4 employs a removable processing cartridge 12 which may be inserted and withdrawn from the main machine frame. Cartridge 12 includes an image recording belt-like member 14 the outer periphery of which is coated with a suitable photoconductive material 15. The belt or charge retentive member is suitably mounted for revolution within the cartridge about driven transport roll 16, around idler roll 18 and travels in the direction indicated by the arrows on the inner run of the belt to bring the image bearing surface thereon past a plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the uniformly charged portion of the belt 14 is moved to exposure station 21 wherein the charged photoconductive surface 15 is exposed to the light image of the original input scene information, whereby the charge is selectively dissipated in the light exposed regions to record the original input scene in the form of an electrostatic latent image.

The optical arrangement creating the latent image comprises a scanning optical system including lamp 17 and mirrors M1, M2, M3 mounted to a scanning carriage (not shown) to scan an original document D on an imaging platen 23. Lens 22 and mirrors M4, M5, M6 transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein toner is applied to the photoconductive surface 15 of the belt 14 rendering the latent image visible. The development station includes a magnetic brush development system including developer roll 25 utilizing a magnetizable developer mix having course magnetic carrier granules and toner colorant particles supplied from developer supply 11 and auger transport 37.

Sheets 31 of final support material are supported in a stack arranged on elevator stack support tray 26. With the stack at its elevated position, a segmented feed and sheet separator roll 27 feeds individual sheets therefrom to a registration pinch roll pair 28. The sheet is then forwarded to a transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt due to the beam strength of the support material 31 as it passes around the idler roll 18. The sheet containing the toner image thereon is advanced to fusing station 41 comprising heated fuser belt 52 (FIG. 1*a*), pressure roll 54 and a plurality of fuser roll structures 56, 58 and 60.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 at a cleaning station 35 which comprises a cleaning blade 36 in scraping contact with the outer periphery of the belt 14. The particles so removed are contained within cleaning housing (not shown) which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

As disclosed in FIG. 1*a*, the fusing apparatus according to the present invention comprises a seamless belt structure 52 having a electrically resistive polyimide layer 64 and a release layer 66 (FIG. 1*b*). The belt is entrained about the fuser rollers 56, 58 and 60 as well as a stripping roller 68 and an idler roller 70. The rollers 56, 58 and 60 are electrically conductive contact rollers which are electrically biased for applying voltages across a portion of the belt structure 52 which physically contacts these rollers. By contact is meant that these rollers contact the electrically resistive polyimide layer 64. The use of a seamless belt construction is an important aspect of the invention in that a seamed belt is subject to arcing and wear at each make and break with the contact rollers. When a seamless belt construction is used there is no breaking of electrical contact to the belt thereby eliminating arcing and wear.

A pressure roller 54 cooperates with the rollers 56, 58 and 60 with a portion of the belt disposed therebetween to form a fusing zone 72 through which substrates or sheets 31 carrying toner images 74 thereon are passed for fusing the toner images 74 to the substrates. The roller 70 serves as an idler or belt steering roller while the roller 68 serves as a stripping roller. A total nip pressure of approximately 50 lbs. is exerted between the fuser roll 60 and the pressure roll 54 by conventional structure used for that purpose.

Alternatively, fusing rollers 58 and 56 need not necessarily form a nip with pressure roller 54 as shown in FIG. 2. As illustrated therein a fly-in zone 51 is provided by the positioning of the rollers 56 and 58 as shown in FIG. 2. As will be noted, many of the components from FIG. 1*a* have been omitted since the they are not needed to illustrate the fly-in feature designated by reference character 51.

Figure 3:
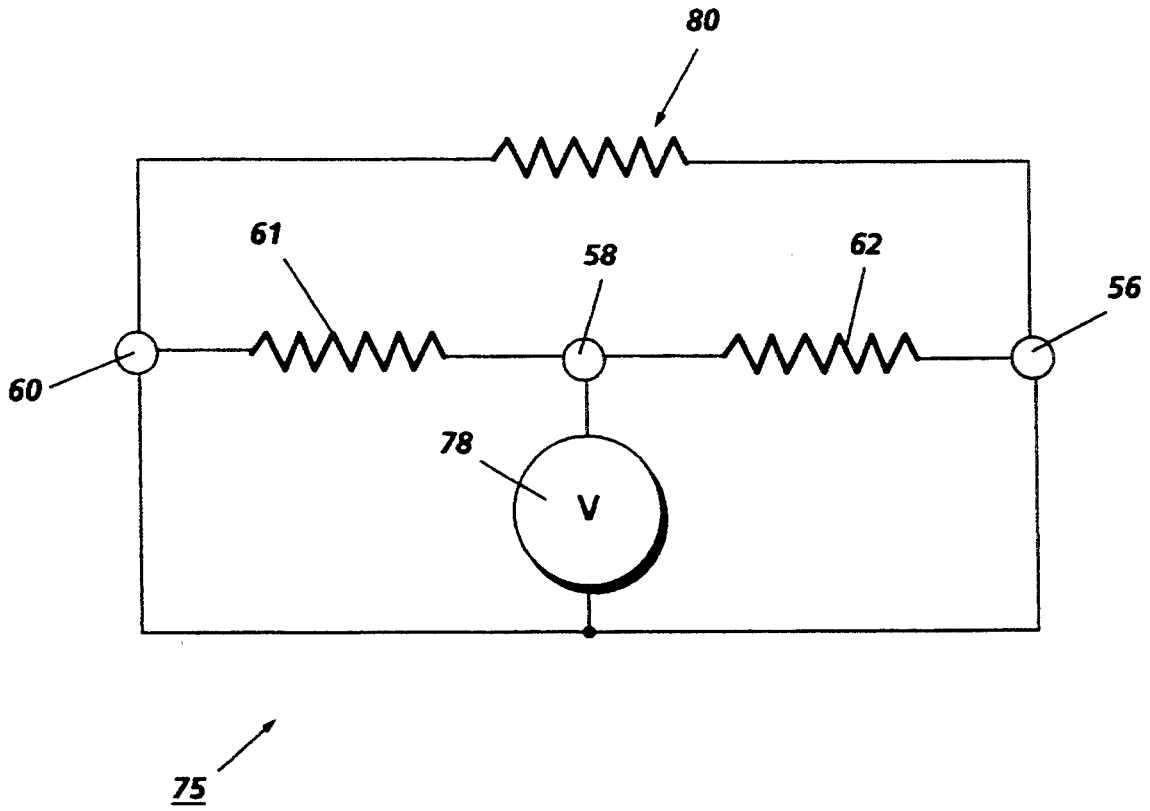
FIG. 3 is a schematic diagram of circuit for enabling the fuser apparatus of FIG. 1 to function in accordance with the present invention.

An electrical circuit 75 (FIG. 3) for applying power to belt segments 61 and 62 in the fusing zone 72, as disclosed in FIG. 1*a*, comprises an AC power source 78 electrically connected to the three conductive fuser rollers 56, 58 and 60. The voltage is applied between the fusing zone entrance roller 56 and the center roller 58 and between the fusing zone exit roller 60 and the center roller as depicted in FIG. 1*a*. Since the entrance and exit rollers are connected together at equal potential the non-fusing zone portion or segment 80 which does not contact any of the rollers 56, 58 and 60 is not heated.

A pad 82 containing a suitable release agent material such as silicone oil is supported in wiping contact with the surface of the belt 52. Thus, the belt surface is thinly coated with silicone oil to prevent toner powder particles from adhering to it.

The above described fuser was reduced to practice using a 50 micron polyimide substrate coated with a 40 micron layer of carbon and graphite loaded fluoropolymer with resistivity of approximately 170 ohms/square. Passing this belt through rollers distanced by 2.25 cm with a voltage differential of 120 VAC developed power of 37 w/cm across the process width. High density (2.0+mg/cm2) color images were well fused at process speeds of 15 cm per second, equivalent to 40 copies per minute.

The temperature in the fusing zone is higher than that created using conventional roll fusers of the prior art. With conventional fusers, the toner temperature is elevated to a point where the toner becomes tackified and not molten. The higher temperature used with the fuser of the present invention guarantees excellent toner melting and flow resulting in improved transparency projection efficiency. Thus, the optical interface between the toner and the transparency is optimized.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. A method of fusing toner images to transparent substrates, said method including the steps of:

forming a fusing zone, having an inlet and outlet, said step of forming a fusing zone comprising contacting a limited area of one side of said belt with three fuser rolls and the other side of said limited area of said belt with a pressure roll such that one of said rollers is positioned at said inlet and another of said rollers is positioned at said outlet;

applying a source of electrical power to said rolls such that said one and said another rolls are at equal potential thereby effecting current flow in said belt only in said limited area thereby effecting heating of only said limited area of said belt;

moving a fusing belt having a smooth surface through said zone; and moving a transparent substrate carrying toner images through said fusing zone with the toner images contacting said smooth surface of said fusing belt.

2. Method according to claim 1 including the step of allowing said toner images to pass through a cooling zone for cooling thereof prior to separating them from contact with said smooth surface of said belt

3. Apparatus for fusing toner images to transparent substrates, said apparatus comprising:

a plurality of rollers forming a fusing zone having an inlet and outlet;

means for supporting said rollers in contact with a limited area of one side of said belt;

a pressure roll supported in contact with said plurality of rollers such that one of said rolls is positioned at said inlet and another of said rolls is positioned at said outlet;

means for applying a source of electrical power to said rolls such that said one and said another rollers are at equal potential thereby effecting current flow in said belt only in said limited area thereby effecting heating of only said limited area of said belt;

means for moving a fusing belt having a smooth surface through said zone; and means for moving a transparent substrate carrying toner images through said fusing zone with the toner images contacting said smooth surface of said fusing belt.

4. Apparatus according to claim 3 including means for effecting cooling of said toner images prior to separation from said belt.

* * * * *